US007508365B2

(12) United States Patent
Kim

(10) Patent No.: US 7,508,365 B2
(45) Date of Patent: Mar. 24, 2009

(54) PIXEL CIRCUIT AND ORGANIC LIGHT EMITTING DISPLAY USING THE SAME

(75) Inventor: Yang Wan Kim, Seoul (KR)

(73) Assignee: Samsung Mobile Display Co., Ltd., Suwon-si (KR)

( * ) Notice: Subject to any disclaimer, the term of this patent is extended or adjusted under 35 U.S.C. 154(b) by 594 days.

(21) Appl. No.: 11/186,424

(22) Filed: Jul. 20, 2005

(65) Prior Publication Data

US 2006/0038754 A1 Feb. 23, 2006

(30) Foreign Application Priority Data

Jul. 28, 2004 (KR) ..... 10-2004-0059018

(51) Int. Cl.
*G09G 3/30* (2006.01)

(52) U.S. Cl. ..... 345/76; 345/92; 345/55; 345/204

(58) Field of Classification Search ..... 345/76, 345/92, 55, 204
See application file for complete search history.

(56) References Cited

U.S. PATENT DOCUMENTS

| | | | | |
|---|---|---|---|---|
| 6,229,506 | B1 | 5/2001 | Dawson et al. | |
| 7,230,375 | B2 * | 6/2007 | Park et al. | 313/506 |
| 2004/0056604 | A1 | 3/2004 | Shih et al. | |
| 2004/0095338 | A1 | 5/2004 | Miyazawa | |
| 2004/0113872 | A1 | 6/2004 | Nanno et al. | |

FOREIGN PATENT DOCUMENTS

| | | | |
|---|---|---|---|
| CN | 1448908 | A | 10/2003 |
| CN | 1494048 | A | 5/2004 |
| EP | 1 102 234 | A3 | 9/2001 |
| KR | 10-2004-0025344 | | 3/2004 |

OTHER PUBLICATIONS

Chinese Office Action dated Jun. 8, 2007, and English translation, for Chinese Application No. 200510098038.8.
Patent Abstracts of Japan, Publication No. 2003-098997, Publication Date Apr. 4, 2003, in the name of Matsumoto et al.
English translation of Title and Abstract, Korean Patent Publication No. 10-2004-0025344; Publication Date Mar. 24, 2004.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A pixel circuit and an organic light emitting display using the same that decrease crosstalk due to a leakage current in an off-region of a pixel switching device to an undetectable (or invisible) level, and compensate for a variation in threshold voltages within itself to provide for uniform brightness. The pixel circuit includes: a first transistor adapted to supply a current corresponding to a voltage applied to a gate thereof to an organic light emitting device; a second transistor adapted to supply a data voltage to a first electrode of the first transistor in response to a first scan signal; a third transistor adapted to connect a second electrode of the first transistor with the gate of the first transistor; and a capacitor adapted to store a voltage corresponding to the data voltage when the first scan signal is applied to the second transistor, and adapted to supply the stored voltage to the gate of the first transistor for the organic light emitting device to emit light.

13 Claims, 7 Drawing Sheets

PIXEL CIRCUIT AND ORGANIC LIGHT EMITTING DISPLAY USING THE SAME

CROSS-REFERENCE TO RELATED APPLICATION

This application claims priority to and the benefit of Korean Patent Application No. 10-2004-00-59018, filed on Jul. 28, 2004, in the Korean Intellectual Property Office, the entire content of which is incorporated herein by reference.

BACKGROUND

1. Field of the Invention

The present invention relates to a pixel circuit and an organic light emitting display using the same, and more particularly, to a pixel circuit and an organic light emitting display using the same which can decrease a crosstalk due to a leakage current in an off-region of a pixel switching device to an undetectable level (or an invisible level), and compensate for variations in threshold voltages within itself to provide for uniform brightness.

2. Discussion of Related Art

Recently, as electric, electronic and semiconductor technologies have been developed, much research is being conducted for an improved flat panel display that can be employed in electronic devices such as monitors, televisions, portable terminals, etc. As a flat panel display, an organic light emitting display has advantages of high brightness, high emission efficiency, high definition, wide view angle, etc.

FIG. 1 is a schematic view of a conventional organic light emitting display 100. In FIG. 1, the organic light emitting display 100 is an active matrix type organic light emitting display.

Referring to FIG. 1, the organic light emitting display 100 includes a scan driver 110 adapted to supply a scan signal to a display panel 130 through a plurality of scan lines S1, S2, . . . , Sn (112); a data driver 120 adapted to transmit a data signal to the display panel 130 through a plurality of data lines D1, D2, D3, . . . , Dm (122); and a plurality of organic light emitting devices 144 adapted to display an image corresponding to the data signal. The display panel 130 includes a plurality of pixel circuits 132 to control the plurality of organic light emitting devices 144. An organic light emitting device 144 can represent a color such as white, red, green or blue with a predetermined brightness corresponding to the scan and data signals transmitted to a corresponding pixel circuit 132.

The display panel 130 is formed on a thin film transistor (TFT) array using a semiconductor process. In FIG. 1, the pixel circuit 132 includes a switching transistor M1, a storage capacitor C, and a driving transistor M2. The switching transistor M1 samples data. The storage capacitor C is programmed with the data. The driving transistor M2 is operated as a voltage source.

However, in the conventional organic light emitting display 100, there is a limit on how uniform the TFT array can be fabricated by a laser annealing process. Because of this limitation, the driving transistors M2 of the respective pixel circuits 132 may have different characteristics from each other, and distances between a power line supplying pixel voltage VDD and the respective pixel circuits 132 are also different from each other, so that a predetermined voltage difference (i.e., a voltage drop) arises in the pixel voltage VDD applied to each pixel circuit 132. To solve this problem, there have been proposed various circuits to compensate a voltage drop and a threshold voltage of the driving transistor in a pixel circuit.

Further, in the conventional organic light emitting display 100, as shown in FIG. 1, a switching transistor M1 of a pixel circuit 132 is connected between the data line Dm and a gate of the driving transistor M2. Therefore, an image data is applied to the gate of the driving transistor M2 through the switching transistor M1. In this case, in the pixel circuit 132 of the conventional organic light emitting display 100, a voltage applied to the gate of the driving transistor M2 varies due to a leakage current or an off-region current of the switching transistor M1. Thus, in a conventional organic light emitting display, a crosstalk arises between adjacent pixels due to a leakage current or a off-region current in a switching transistor.

SUMMARY OF THE INVENTION

An embodiment of the present invention provides a pixel circuit and an organic light emitting display using the same, in which voltage applied to a gate of a driving transistor is kept constant regardless of a leakage current in a switching transistor.

An embodiment of the present invention provides a pixel circuit and an organic light emitting display using the same, in which a deviation between threshold voltages of driving transistors is compensated regardless of a fabrication process factor.

One embodiment of the present invention provides a pixel circuit of an organic light emitting display, including: a first transistor adapted to supply current corresponding to a voltage applied to a gate of the first transistor to an organic light emitting device; a second transistor adapted to supply a data voltage to a first electrode of the first transistor in response to a first scan signal; a third transistor adapted to connect a second electrode of the first transistor with the gate of the first transistor; and a capacitor adapted to store a voltage corresponding to the data voltage when the first scan signal is applied to the second transistor, and adapted to supply the stored voltage to the gate of the first transistor for the organic light emitting device to emit light.

According to one embodiment of the invention, the pixel circuit further includes a fourth transistor adapted to cut off a pixel voltage from being applied to the first electrode of the first transistor in response to an emission control signal. Further, the pixel circuit further includes a fifth transistor adapted to cut off an electrical connection between the second electrode of the first transistor and the organic light emitting device in response to the emission control signal. Also, the pixel circuit further includes a sixth transistor adapted to discharge the voltage stored in the capacitor in response to a second scan signal.

One embodiment of the present invention provides a pixel circuit of an organic light emitting display, including: a first transistor comprising a first electrode adapted to receive a pixel voltage, a second electrode electrically connected to an organic light emitting device, and a gate; a second transistor including a first electrode adapted to receive a data voltage, a second electrode connected to the first electrode of the first transistor, and a gate adapted to receive a first scan signal; a third transistor connected between the second electrode of the first transistor and the gate of the first transistor, and for allowing the first transistor to function as a diode; a capacitor including a first electrode connected to a power line for supplying the pixel voltage, and a second electrode connected to the gate of the first transistor; a fourth transistor including a first electrode connected to the power line, a second electrode connected to the first electrode of the first transistor, and a gate adapted to receive an emission control signal; a fifth transistor including a first electrode connected to the second electrode of the first transistor, a second electrode connected to an anode of the organic light emitting device, and a gate adapted to receive the emission control signal.

According to one embodiment of the invention, the pixel circuit further includes a sixth transistor including a first electrode connected to the second electrode of the capacitor, a second electrode, and a gate adapted to receive a second scan signal.

One embodiment of the present invention provides an organic light emitting display including: a plurality of data lines adapted to transmit a data voltage; a plurality of scan lines adapted to transmit a scan signal; a plurality of organic light emitting devices adapted to display an image corresponding to the data voltage; and a plurality of pixel circuits electrically connected to the data lines, the scan lines, and the organic light emitting devices, wherein at least one of the pixel circuits includes: a first transistor adapted to supply a current to the organic light emitting device; a second transistor adapted to supply the data voltage to a first electrode of the first transistor in response to a first scan signal; a third transistor adapted to connect a second electrode of the first transistor with the gate of the first transistor; and a capacitor adapted to store a voltage corresponding to the data voltage when the first scan signal is applied to the second transistor, and adapted to supply the stored voltage to the gate of the first transistor for the organic light emitting device to emit light.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

Figure 1:
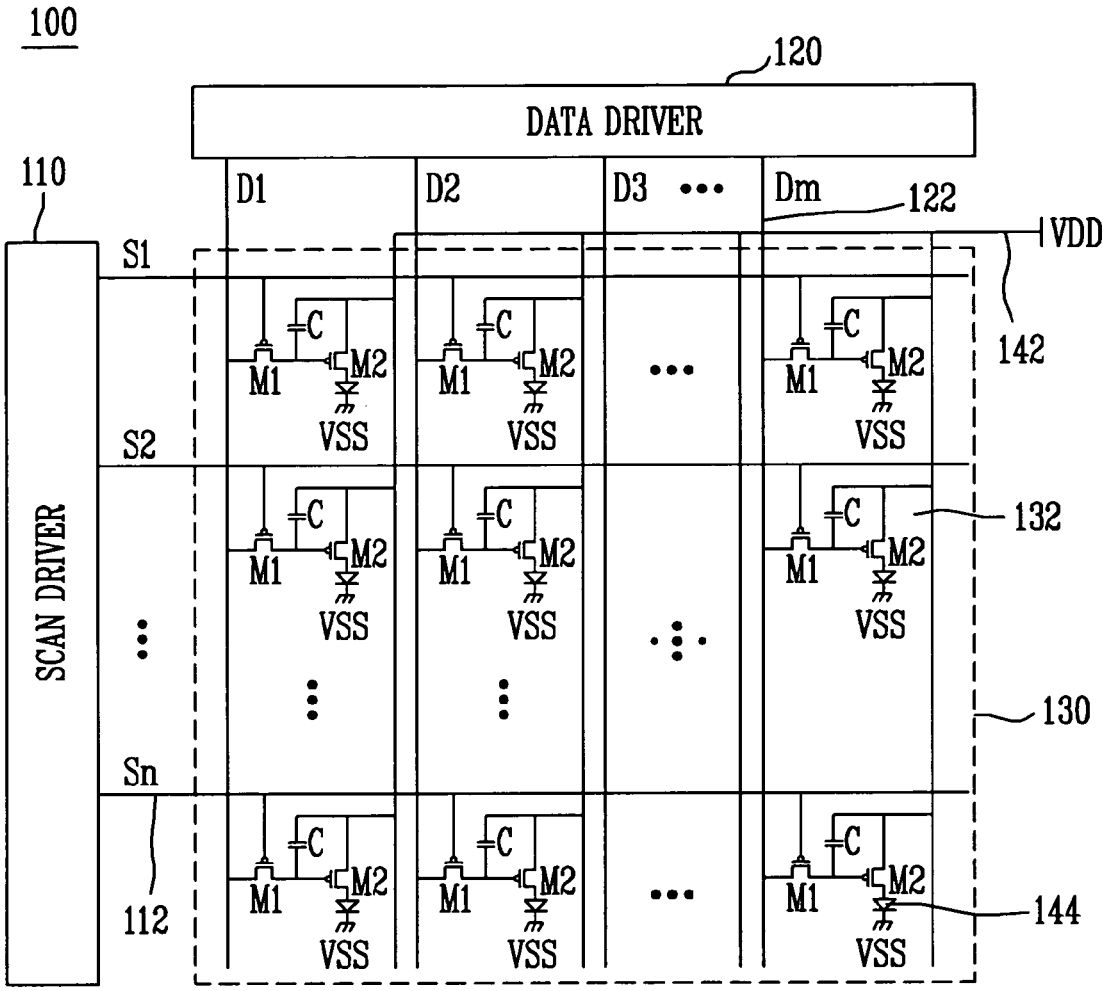
FIG. 1 (PRIOR ART)
FIG. 1 is a schematic view of a conventional organic light emitting display.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification, as they are not essential to a complete understanding of the invention. Like reference numerals designate like elements.

In the following descriptions, when some part is described to be connected to some other part, it includes not only the case where they are connected directly but also the case where they are electrically connected by having some other element therebetween. Further, the transistor can be described as having, including or comprising a source, a drain and a gate; or having, including or comprising a first terminal (e.g., a source or a drain), a second terminal (e.g., a drain when the first terminal is the source or a source when the first terminal is the drain), and a control terminal (e.g., a gate).

Figure 2:
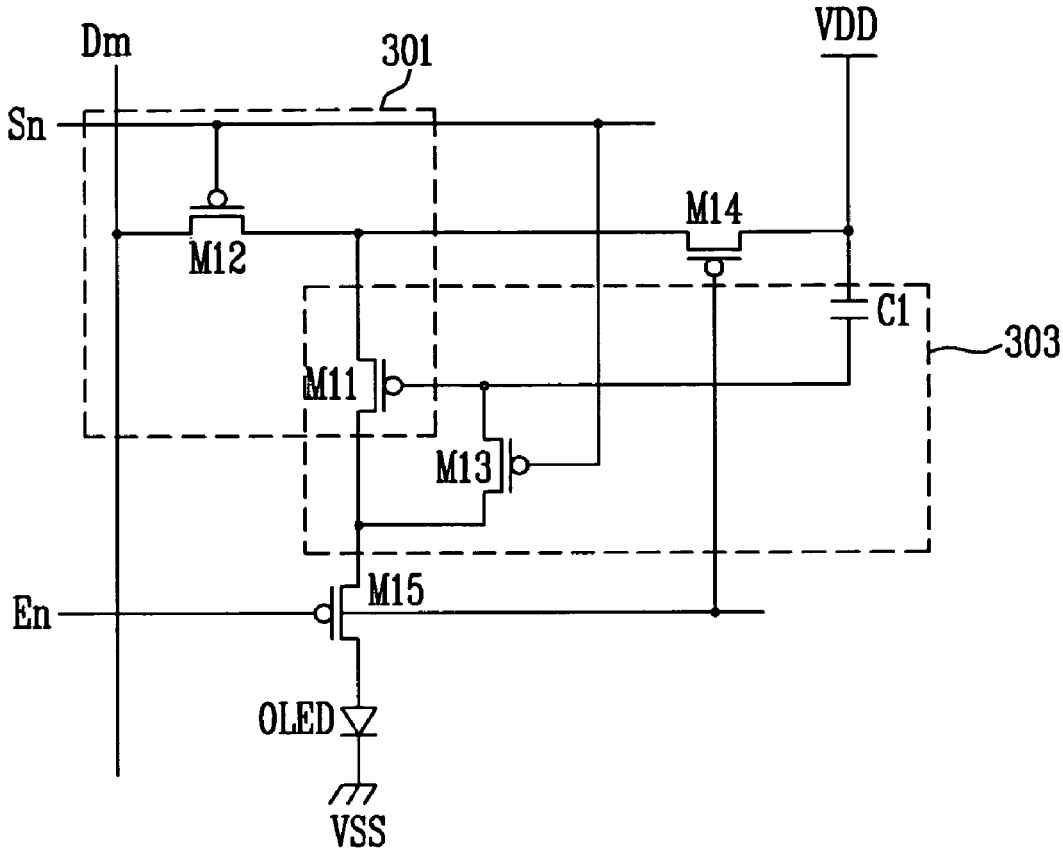
FIG. 2 is a circuit diagram of a pixel circuit in an organic light emitting display according to a first embodiment of the present invention.

FIG. 2 is a circuit diagram of a pixel circuit in an organic light emitting display according to a first embodiment of the present invention.

Referring to FIG. 2, the pixel circuit includes first through fifth transistors M11, M12, M13, M14, M15 and one capacitor C1. The first transistor M11 is used as a driving transistor to apply current to an organic light emitting diode (OLED) having a cathode connected to a second power line. The other second through fifth transistors M12, M13, M14 and M15 are used as a switching transistor. The first through fifth transistors M11 through M15 are each of a p-type transistor (or a transistor of a p-channel type). The OLED includes an multi-layered organic thin film containing a fluorescent or phosphoric organic compound, and an anode and a cathode connected to opposite terminals of the organic thin film.

In more detail, the first transistor M11 includes a source connected to a drain of the second transistor M12, a drain connected to a source of the fifth transistor M15, and a gate connected to a second electrode of the capacitor C1. The second transistor M12 includes a source connected to a data line Dm, and a gate connected to an nth scan line Sn to transmit an nth scan signal, where 'n' is an arbitrary natural number. The third transistor M13 includes a source connected to the drain of the first transistor M11, a drain connected to the gate of the first transistor M11, and a gate connected to the scan line Sn. The fourth transistor M14 includes a source connected to a first power line applying a first pixel voltage VDD, and a drain connected to the source of the first transistor M11, and a gate connected to an emission control line En to transmit an emission control signal. The fifth transistor M15 includes a source connected to the drain of the first transistor M11, a drain connected to the anode of the OLED, and a gate connected to the emission control line En. The capacitor C1 includes a first electrode connected to the first power line and a second electrode connected to the gate of the first transistor M11. The OLED includes the cathode connected to the second power line to supply a second pixel voltage VSS.

As described above, in the pixel circuit according to the first embodiment of the present invention, the second transistor M12 is connected to the data line Dm and the source of the first transistor M11 (refer to 301 of FIG. 2). Further, the drain and the gate of the first transistor M11 are connected as a diode by the third transistor M13, and the gate of the first transistor M11 is connected to the first terminal or electrode of the capacitor C1 (refer to 303 of FIG. 2). Further, each gate of the second and third transistors M12 and M13 is connected to the nth scan line Sn to transmit the nth scan signal, where 'n' is an arbitrary natural number.

With this configuration, when the data voltage applied to the data line Dm varies, the voltage applied to the gate of the first transistor M11 is not substantially varied even if a leakage current flows into or from the source of the first transistor M11 through the second transistor M12. Hence, the pixel circuit according to the first embodiment of the present invention protects the organic light emitting display from a crosstalk problem due to the leakage current in the gate of the driving transistor. For example, in the case where a switching transistor is connected between a data line and the gate of a driving transistor, a visibly detectable level of crosstalk of about 2% appears in a conventional pixel circuit, but an undetectable (or invisible) level of crosstalk of about 0.8% appears in a pixel circuit according to the first embodiment of the present invention, thereby substantially solving the crosstalk problem.

Further, in the foregoing configurations, the data signal sampled by the second transistor M12 is applied to the capacitor C1 through the diode-connected first transistor M11 and the third transistor M13, so that the threshold voltage of the driving transistor M11 is compensated by itself, and the voltage corresponding to the data signal is stored in the capacitor C1 regardless of the threshold voltage of the driving transistor M11. Thus, in a pixel circuit according to the first embodiment of the present invention, a deviation between threshold voltages of various driving transistors is compensated regardless of a fabrication process factor.

In FIG. 2, a current flowing in the OLED can be calculated by the following equations 1 and 2.

$$I_{OLED} = \frac{\beta}{2}(V_{GS} - V_{TH})^2 \quad \text{equation 1}$$

$$I_{OLED} = \frac{\beta}{2}[(V_{DD} - V_{DATA} + V_{TH}) - V_{TH}]^2 = \frac{\beta}{2}(V_{DD} - V_{DATA})^2 \quad \text{equation 2}$$

where IOLED indicates the current flowing in the OLED, VGS indicates voltage applied between the gate and the source of the first transistor M11, VTH indicates the threshold voltage of the first transistor M11, VDD indicates the first pixel voltage, and β indicates a predetermined constant.

Referring to the equations 1 and 2, the current corresponding to the data voltage applied to the data line Dm flows in the OLED regardless of the threshold voltage of the first transistor M11 used as the driving transistor.

Further, as described above, in the pixel circuit according to the first embodiment of the present invention, the source of the first transistor M11 receiving the first pixel voltage VDD is connected in a manner that cuts off the first pixel voltage VDD when the second transistor M12 is turned on. In other words, according to the first embodiment of the present invention, the fourth transistor M14 is turned off while the voltage corresponding to the data signal is stored in the capacitor C1. Further, the fourth transistor M14 is turned on when the first transistor M11 is operated as a predetermined static current source on the basis of the voltage stored in the capacitor C1.

According to the first embodiment of the present invention, the pixel circuit includes a structure for cutting off electrical connection between the drain of the first transistor M11 and the anode of the OLED while the first transistor M11 is connected as a diode. For example, according to the first embodiment, the fifth transistor M15 is turned off while the data voltage is stored in the capacitor C1, and turned on when the first transistor M11 is operated as a predetermined static current source on the basis of the voltage stored in the capacitor C1. Thus, each OLED of the first embodiment can emit light with uniform brightness.

Thus, in a pixel circuit according to the first embodiment of the present invention, a gate voltage of a driving transistor is substantially prevented from varying due to a leakage current from an off-region of a pixel switching device (such as the second transistor M12). With this configuration, the organic light emitting display employing the pixel circuit according to the first embodiment of the present invention decreases the crosstalk to a invisible level.

Further, the first embodiment of the present invention not only provides for a pixel switching device (such as the second transistor M12) that is connected to a source or a drain of a driving transistor (p- or n-type transistor) but also provides for connecting the driving transistor as a diode, thereby storing the data voltage in the capacitor (e.g., C1). Because of this configuration, the threshold voltage of the driving transistor is compensated by itself. Thus, the organic light emitting display employing the pixel circuit according to the first embodiment of the present invention uniformizes the brightness regardless of the threshold voltage of the driving transistor.

Figure 3:
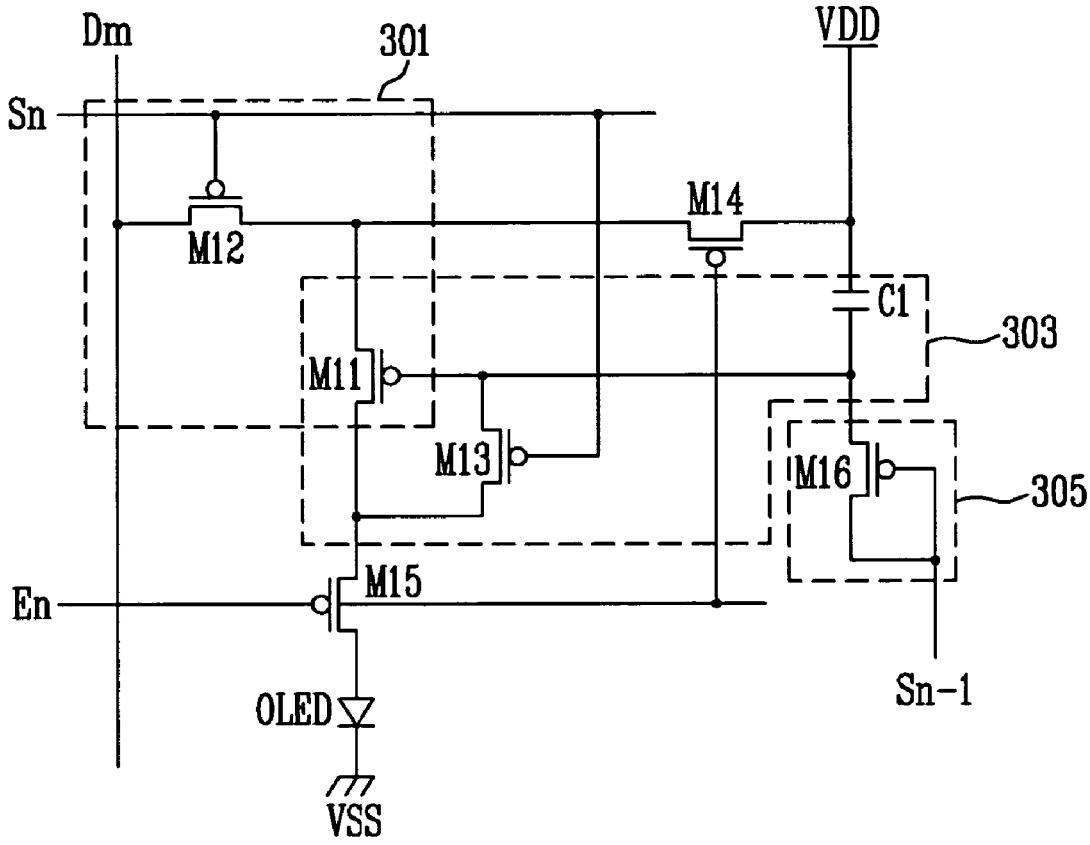
FIG. 3 is a circuit diagram of a pixel circuit in an organic light emitting display according to a second embodiment of the present invention.

FIG. 3 is a circuit diagram of a pixel circuit in an organic light emitting display according to a second embodiment of the present invention. The pixel circuit according to the second embodiment of the present invention includes substantially the same configuration as that of the first embodiment except for an initializing part 305 for initializing a capacitor C1.

Referring to FIG. 3, the pixel circuit includes first through sixth transistors M11, M12, M13, M14, M15, M16 and one capacitor C1. The first transistor M11 is used as a driving transistor to supply current to an OLED having a cathode connected to a second power line. The other second through sixth transistors M12 through M16 are each used as a switching transistor. The first through sixth transistors M11 through M16 are of a p-type transistor.

The sixth transistor M16 includes a source connected to a first electrode of the capacitor C1 connected to the gate of the first transistor M11. Further, a drain and a gate of the sixth transistor M16 are connected, thereby allowing the sixth transistor M16 to function as a diode. Also, the gate of the sixth transistor M16 is connected to a second scan line Sn-1. In a case of the organic light emitting display operating in a line addressing manner, the second scan line Sn-1 indicates a scan line supplying a scan signal to a previous pixel circuit on the assumption that a scan line of a current pixel circuit supplying a scan signal to the gate of the second transistor M12 is regarded as the first scan line Sn.

Further, the gate of the sixth transistor M16 can be connected to other control lines or other scan lines to transmit a separate control signal or a separate scan signal. However, in this case, these other lines may need to be added in the pixel circuit, so that there arises a problem that aperture ratio is decreased. To prevent the aperture ratio from being decreased, the gate of the sixth transistor M6 of FIG. 3 is connected to the second scan line Sn-1.

According to the second embodiment of the present invention, the fourth and fifth transistors can each be realized by an n-type transistor as well as the p-type transistor shown in FIG. 3. In the case of n-type fourth and fifth transistors, the n-type fourth and fifth transistors are operated by a reversed emission control signal as compared with the emission control signal for the p-type fourth and fifth transistors M14 and M15 shown in FIG. 3.

Thus, in a pixel circuit according to the second embodiment of the present invention, a voltage stored in a capacitor (e.g., the capacitor C1) is discharged through a transistor (e.g., the transistor M16) connected to the capacitor as a diode, and therefore the capacitor is initialized before the image data is programmed in the capacitor. As such, the discharging of voltage previously stored in (or the initializing of) the capacitor allows a later voltage corresponding to the data signal of the following frame to be securely stored in the capacitor. Further, there is no need in this embodiment to provide a separate control line and a separate initializing line. Also, the aperture ratio of this embodiment is increased.

Figure 4:
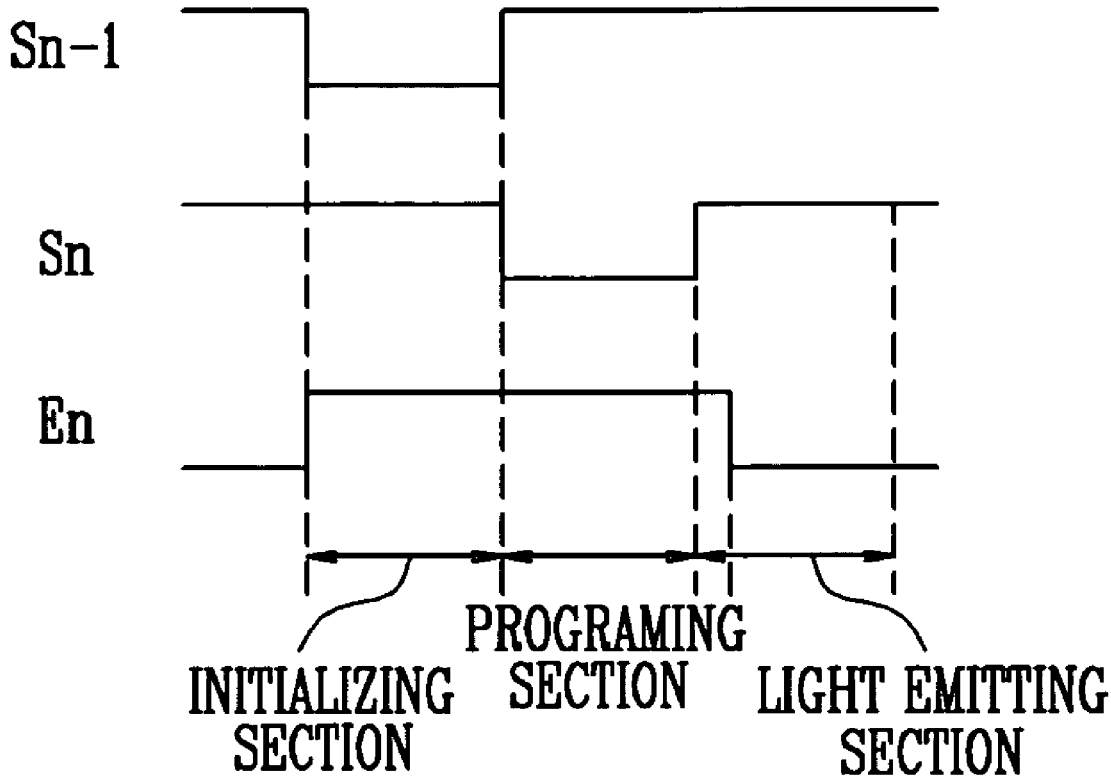
FIG. 4 is a view showing waveforms of signals applied to the pixel circuit of FIG. 3.

FIG. 4 is a view showing waveforms of signals applied to the pixel circuit shown in FIG. 3. According to the second embodiment of the present invention, the first scan signal indicates a scan signal applied to a current scan line Sn, the second scan signal indicates a scan signal applied to a previous scan line Sn-1, and the emission control line indicates to a signal applied to the emission control line En.

Referring to FIG. 4, the pixel circuit operates in a first period or an initializing period for initializing the capacitor C1, a second period or a programming period for storing a voltage corresponding to the data signal in the capacitor C1, and a third period or an emission period during which the driving transistor M11 functions as a predetermined static current source to supply a current to the OLED on the basis of the voltage stored in the capacitor C1 and the OLED emits light with brightness corresponding to the current. Here, the second scan signal and the first scan signal are not superposed but sequentially transmitted. Further, the emission control signal is transmitted with a disable level while the first and second scan signals have enable levels respectively. Also, the first and second scan signals are shifted with respect to each other, but are otherwise substantially the same signal.

For the first period, the first scan signal having a high level is transmitted to the first scan line Sn; the emission control signal having a high level is transmitted to the emission control line En; and the second scan signal having a low level is transmitted to the second scan line Sn-1, so that the second and third transistors M12 and M13 are turned off by the first scan signal; the fourth and fifth transistors M14 and M15 are turned off by the emission control signal; and the sixth transistor M16 is turned on by the second scan signal.

At this time, the voltage stored in the capacitor C1 is discharged through the second scan line Sn-1, thereby initializing the capacitor C1. Therefore, the gate voltage of the first transistor M11 connected to the first electrode of the capacitor C1 is initialized.

For the second period, the first scan signal having a low level is transmitted to the first scan line Sn; the second scan signal having a high level is transmitted to the second scan line Sn-1; and the emission control signal having the high level is transmitted to the emission control line En, so that the second and third transistors M12 and M13 are turned on by the first scan signal; the fourth and fifth transistors M14 and M15 are turned off by the emission control signal; and the sixth transistor M16 is turned off by the second scan signal.

At this time, the data voltage applied to the data line Dm is applied to the first electrode of the capacitor C1 through the second transistor M12, the first transistor M11, and the third transistor M13. Thus, the capacitor C1 stores voltage corresponding to difference between the first pixel voltage VDD and the data voltage for the second period. With this configuration, the capacitor C1 can store the voltage corresponding to the data voltage regardless of the threshold voltage of the driving transistor M11.

For the third period, the first scan signal having the high level is transmitted to the first scan line Sn; the second scan signal having the high level is transmitted to the second scan line Sn-1; and the emission control signal having a low level is transmitted to the emission control line En, so that the second and third transistors M12 and M13 are turned off by the first scan signal; the fourth and fifth transistors M14 and M15 are turned on by the emission control signal; and the sixth transistor M16 is turned off by the second scan signal.

At this time, the first transistor M11 functions as the static current source by the capacitor C1 that is connected between the gate and the source and stores voltage corresponding to the image data, thereby supplying a predetermined current from the first pixel voltage VDD to the OLED. With this configuration, the OLED represents the image data with a proper brightness. In other words, the OLED according to the second embodiment of the present invention clearly represents red, green, blue and/or white with a predetermined gray level.

Figure 5:
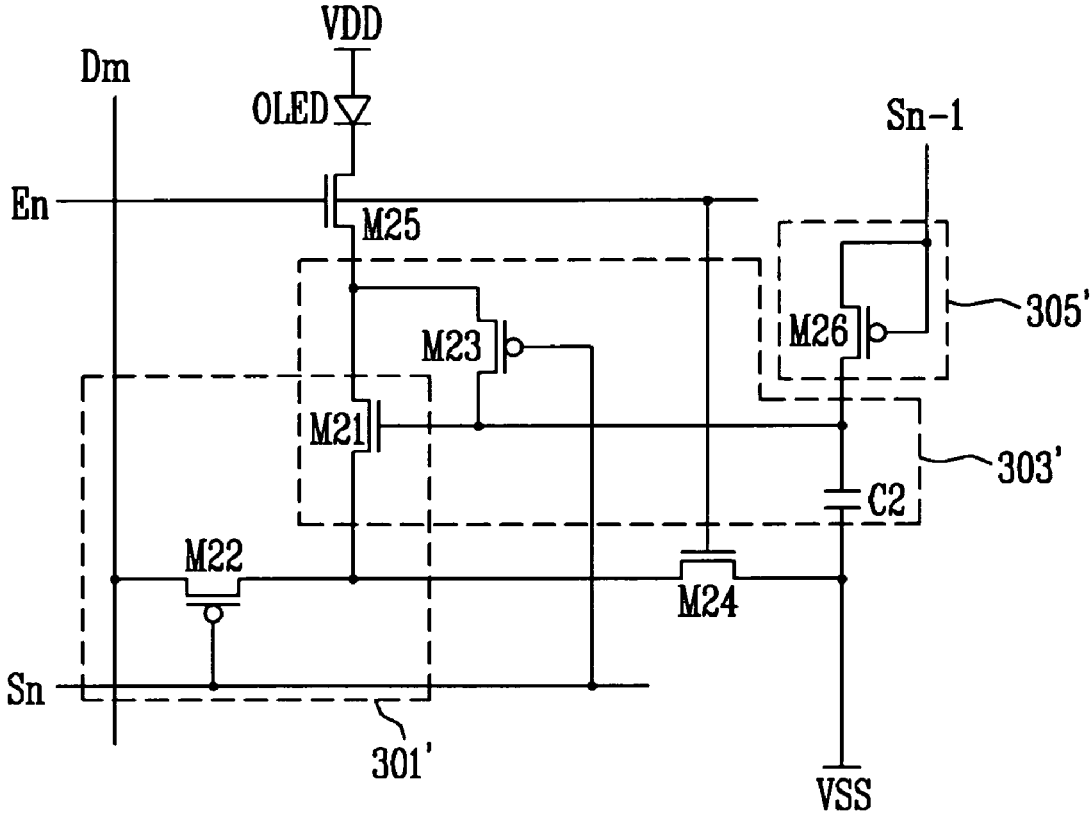
FIG. 5 is a circuit diagram of another example of a pixel circuit in the organic light emitting display according to the second embodiment of the present invention.
Figure 6:
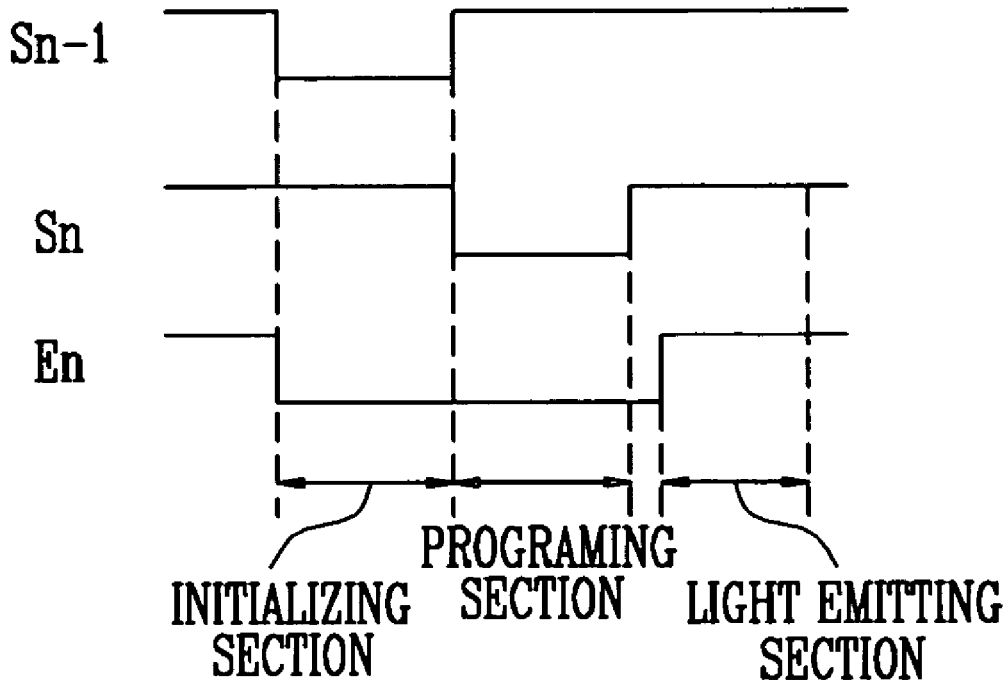
FIG. 6 is a view showing waveforms of signals applied to the pixel circuit of FIG. 5.

FIG. 5 is a circuit diagram of another example of a pixel circuit in the organic light emitting display according to the second embodiment of the present invention, and FIG. 6 is a view showing waveforms of signals applied to the pixel circuit shown in FIG. 5.

Referring to FIG. 5, a pixel circuit according to this embodiment of the present invention includes first through sixth transistors M21, M22, M23, M24, M25 and M26 and one capacitor C2. The first transistor M21 is used as a driving transistor to supply current to an OLED. The other second through sixth transistors M22 through M26 are used as a switching transistor. Here, each of the first, fourth and fifth transistors M21, M24, M25 is an n-type transistor (or a transistor of an n-channel type). Further, each of the second, third and sixth transistors M22, M23, M26 is a p-type transistor (or a transistor of a p-channel type). The OLED includes a multi-layered organic thin film containing a fluorescent or phosphoric organic compound, and an anode and a cathode connected to opposite terminals of the organic thin film.

In more detail, the first transistor M21 includes a source connected to a drain of the second transistor M22, a drain connected to a source of the fifth transistor M25, and a gate connected to a first electrode of the capacitor C2. The second transistor M22 includes a source connected to a data line Dm, and a gate connected to an nth scan line Sn to transmit an nth scan signal, where 'n' is an arbitrary natural number. The third transistor M23 includes a source connected to the drain of the first transistor M21, a drain connected to the gate of the first transistor M21, and a gate connected to the scan line Sn. The fourth transistor M24 includes a drain connected to the source of the first transistor M21, a source connected to a second power line for applying a second pixel voltage VSS, and a gate connected to an emission control line En to transmit an emission control signal. The fifth transistor M25 includes a drain connected to the anode of the OLED, the source connected to the drain of the first transistor M21, and a gate connected to the emission control line En. The capacitor C2 includes a second electrode connected to the second power line. The OLED includes the anode connected to a first power line to supply a first pixel voltage VDD.

In FIG. 5, the second transistor M22 is connected to the data line Dm and the source of the first transistor M21 (refer to 301' of FIG. 5). In addition, the drain and the gate of the first transistor M21 are connected as a diode by the third transistor M23, and the gate of the first transistor M21 is connected to the first electrode of the capacitor C2 (refer to 303' of FIG. 5).

The sixth transistor M26 (refer to 305' of FIG. 5) includes a source connected to the first electrode of the capacitor C2 connected to the gate of the first transistor M21. Further, a drain and a gate of the sixth transistor M26 are connected, thereby allowing the sixth transistor M6 to function as a diode. Also, the gate of the sixth transistor M26 is connected to a second scan line Sn-1.

With this configuration, current flowing in the OLED can be calculated by the following equation 3 based on the equation 1.

$$I_{OLED} = \frac{\beta}{2}[(V_{DATA} + V_{TH} - V_{SS}) - V_{TH}]^2 = \frac{\beta}{2}(V_{DATA} - V_{SS})^2 \quad \text{equation 3}$$

where IOLED indicates current flowing in the OLED, VGS indicates voltage applied between the gate and the source of the first transistor M21, VTH indicates the threshold voltage of the first transistor M21, VDATA indicates the data voltage, VSS indicates the second pixel voltage, and β indicates a predetermined constant.

Referring to the equation 3, the current corresponding to the data voltage applied to the data line Dm flows in the OLED regardless of the threshold voltage of the first transistor M21 used as the driving transistor.

Referring to FIG. 6, the pixel circuit operates in a first period or a initializing period for initializing the capacitor C2, a second period or a programming period for storing voltage corresponding to the data signal in the capacitor C2, and a third period or an emission period during which the driving transistor M21 functions as a predetermined static current source to supply the current to the OLED on the basis of the voltage stored in the capacitor C2 and the OLED emits light with brightness corresponding to the current. Here, the second scan signal and the first scan signal are not superposed but sequentially transmitted. Further, the emission control signal is transmitted with a disable level while the first and second scan signals have enable levels respectively. Also, the first and second scan signals are shifted with respect to each other, but are otherwise substantially the same signal.

The initializing period, the programming period and the emission period are substantially the same as those of the pixel circuit of the second embodiment shown in FIGS. 3 and 4, except that the emission control signal transmitted to the pixel circuit is reversed.

In the embodiment shown in FIG. 5, the second and third transistors M22 and M23 are each realized by the p-type transistor in order to use the scan signal that is shifted with but is otherwise substantially the same as the scan signal applied to the gate of the sixth transistor M26. Therefore, depending on the scan signals that are applied from the different scan signal lines to the second, third and sixth transistors M22, M23 and M26, the second, third and sixth transistors M22, M23 and M26 can be selected as either the n-type transistor or the p-type transistor. Here, the sixth transistor M26 is formed by using the p-type transistor to discharge the voltage stored in the capacitor C2 through the previous scan line Sn-1.

In this embodiment, the fourth and fifth transistor M24 and M25 each can be formed by using a p-type transistor as well as the n-type transistor shown in FIG. 5. In the p-type case, the p-type fourth and fifth transistors are operated by a reversed emission control signal as compared with the emission control signal for the n-type fourth and fifth transistors.

Figure 7:
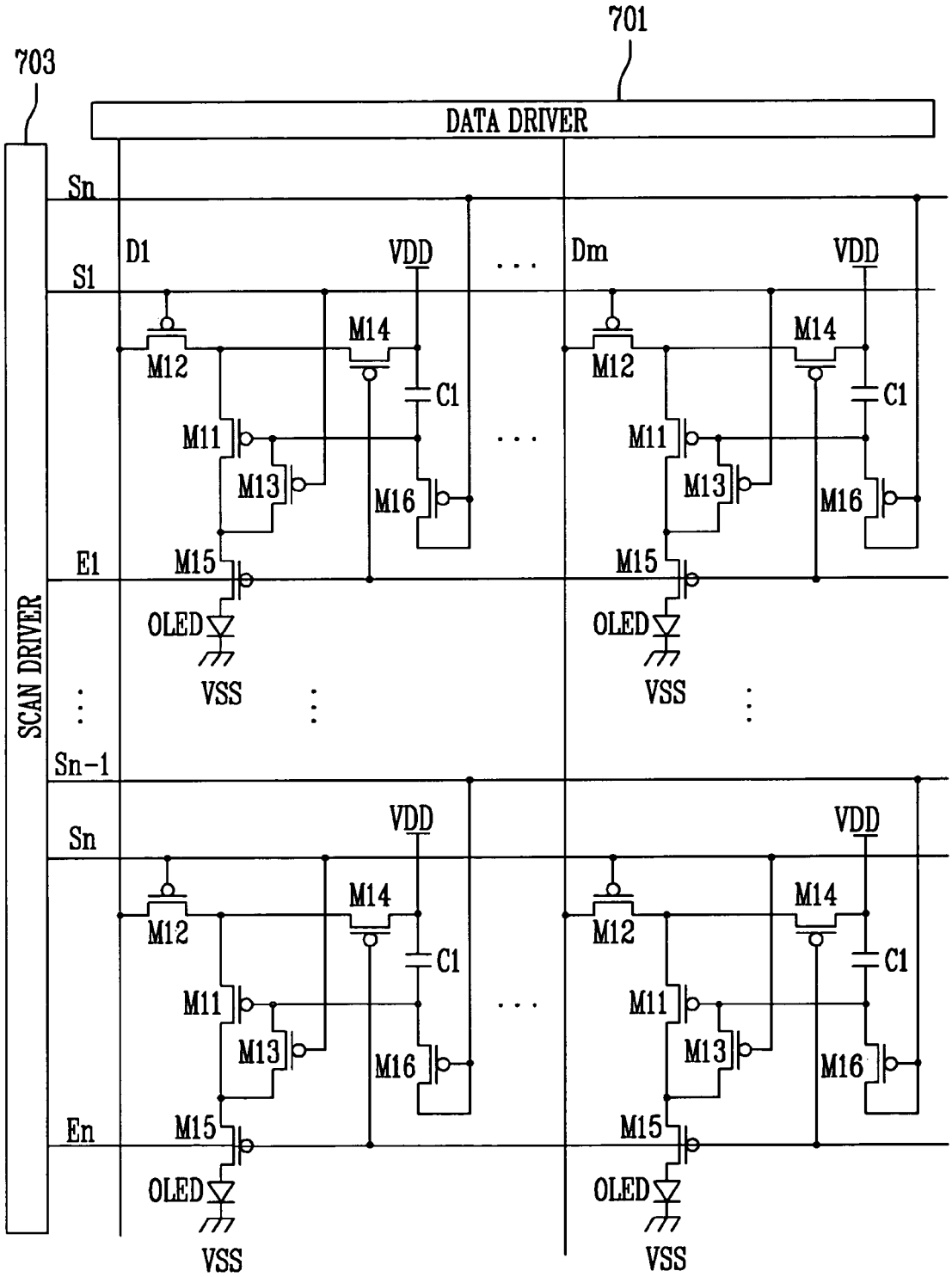
FIG. 7 is a schematic view of an organic light emitting display employing the pixel circuit according to the second embodiment of the present invention.

FIG. 7 is a schematic view of an organic light emitting display employing the pixel circuit according to the second embodiment of the present invention.

Referring to FIG. 7, the organic light emitting display includes a plurality of data lines D1, . . . , Dm connected to a data driver 701 and for transmitting data signals to pixel circuits; first and second scan lines S0, S1, . . . , Sn-1, Sn and emission control lines E1, . . . , En, which are connected to a scan driver 703 and are for transmitting first and second scan signals and emission control signals to the pixel circuits, respectively; and N×M pixel circuits. Here, Dm indicates an mth data line, and Sn indicates an nth scan line (where 'm' and 'n' are arbitrary natural numbers). With regard to the first and second scan lines according to a line addressing manner, the second scan line (e.g., Sn-1) indicates a scan line connected to a previous pixel circuit and for transmitting a scan signal to the previous pixel circuit on the assumption that a scan line connected to a current pixel circuit and for transmitting a scan signal to the current pixel circuit is regarded as the first scan line (e.g., Sn).

Each of the pixel circuits shown includes the first through sixth transistors M11, M12, M13, M14, M15 and M16 and one capacitor C1. The first through sixth transistors M11 through M16 are each realized by a p-type transistor. Hereinbelow, the pixel circuit formed in a pixel region defined by the mth data line and the nth scan line will be described by way of example.

The first transistor M11 supplies a driving current to the OLED. The second transistor M12 supplies a data voltage to the source of the first transistor M11 in response to the first scan signal having a low level of the first scan line Sn. The third transistor M13 is connected between the drain and the gate of the first transistor M11 and allows the first transistor M11 to function as a diode in response to the first scan signal having the low level of the first scan line Sn.

The capacitor C1 is connected between a first power line for supplying a first pixel voltage VDD and the gate of the first transistor M11. Further, the capacitor C1 stores the voltage corresponding to the data voltage applied through the second transistor M12, the first transistor M11, and the third transistor M13, i.e., corresponding to difference between the first pixel voltage VDD and the data voltage.

The fourth transistor M14 is connected between the source of the first transistor M11 and the first power line, and is turned off in response to the emission control signal having a high level of the emission control line En while the second transistor M12 is turned on. With this configuration, the fourth transistor M14 cuts off the first pixel voltage VDD from being applied to the source of the first transistor M11 while the second transistor M12 is turned on.

The fifth transistor M15 is connected between the drain of the first transistor M11 and the anode of the OLED, and is turned off in response to the emission control signal having the high level of the emission control line En while the second and third transistors M12 and M13 are turned on. With this configuration, the fifth transistor M15 prevents the current from flowing through the second and first transistors M12 and M11 while the second and third transistors M12 and M13 are turned on. Further, the fifth transistor M15 prevents abnormal voltage from being applied from the outside to the drain of the first transistor M11 through the OLED.

The sixth transistor M16 includes a source connected to a first electrode of the capacitor C1, a drain and a gate connected as a diode, and connected to the second scan line Sn-1. Because of this, the sixth transistor M16 discharges the voltage stored in the capacitor C1 through the second scan line Sn-1, and is connected as a diode in response to the second scan signal transmitted to the second scan line Sn-1 in order to initialize the gate voltage of the first transistor M11. With this configuration, the organic light emitting display employing the pixel circuit according to the second embodiment of the present invention is fabricated.

In general, an organic light emitting display according to an embodiment of the present invention prevents a crosstalk generated when a gate voltage of a driving transistor is varied by a leakage current, and supplies a current corresponding to an image data to a light emitting device regardless of the threshold voltage of the driving transistor, thereby representing a proper brightness.

In view of the foregoing, a pixel circuit of an embodiment of the present invention includes MOS transistors, but the present invention is not limited to and may include various other suitable transistors as well as the MOS transistors shown. For example, the pixel circuit can include an active device, which include first, second and third electrodes, and controls the amount of current flowing from the second electrode to the third electrode on the basis of the voltage applied between the first and second electrodes.

Further, a plurality of switching transistors (e.g., the second through sixth transistors M12, M13, M14, M15 and M16) can be employed for switching and/or selectively connecting opposite electrodes in response to scan signals (e.g., the first and second scan signals). Alternatively, various devices can substitute for the switching transistors as long as such devices can switch and/or selectively connect the opposite electrodes in response to the scan signals.

As described above, the present invention provides a pixel circuit and an organic light emitting display using the same, which can prevent a crosstalk generated when a gate voltage of a driving transistor is varied by a leakage current.

Further, the present invention provides a pixel circuit and an organic light emitting display using the same, in which the pixel circuit is configured to compensate a threshold voltage of a driving transistor (e.g., a thin film transistor) by itself, thereby representing a proper brightness.

Still further, the present invention provides a pixel circuit and an organic light emitting display using the same, which initializes a capacitor storing a data voltage by using a diode-connected transistor, thereby enhancing an aperture ratio without a separate initializing line.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A pixel circuit of an organic light emitting display, comprising:

a first transistor adapted to supply a current corresponding to a voltage applied to a gate of the first transistor to an organic light emitting device;

a second transistor adapted to supply a data voltage to a first electrode of the first transistor in response to a first scan signal;

a third transistor adapted to connect a second electrode of the first transistor with the gate of the first transistor;

a capacitor adapted to store a voltage corresponding to the data voltage when the first scan signal is applied to the second transistor, and adapted to supply the stored voltage to the gate of the first transistor for the organic light emitting device to emit light;

a fourth transistor adapted to cut off a pixel voltage from being applied to the first electrode of the first transistor in response to an emission control signal;

a fifth transistor adapted to cut off an electrical connection between the second electrode of the first transistor and the organic light emitting device in response to the emission control signal; and a sixth transistor adapted to discharge the voltage stored in the capacitor in response to a second scan signal.

2. The pixel circuit according to claim 1, wherein the sixth transistor comprises a first electrode connected to the capacitor, a gate adapted to receive the second scan signal, and a second electrode connected to a scan line for transmitting the second scan signal.

3. The pixel circuit according to claim 2, wherein the first, second, third, fourth, fifth, and sixth transistors are equivalent to each other in a transistor channel type.

4. The pixel circuit according to claim 2, wherein each of the first, second, third, fourth, fifth, and sixth transistors comprises a p-type transistor.

5. The pixel circuit according to claim 2, wherein at least one of the first, second, third, fifth, and sixth transistors is different in a transistor channel type from at least another one of the first, second, third, fifth, and sixth transistors.

6. The pixel circuit according to claim 2, wherein at least one of the first, second, third, fourth, fifth, and sixth transistors comprises a p-type transistor and at least another one of the first, second, third, fourth, fifth, and sixth transistors comprises an n-type transistor.

7. The pixel circuit according to claim 1, wherein the second scan signal and the first scan signal are sequentially transmitted, and the emission control signal is transmitted with a disable level, and wherein the first and second scan signals are shifted to respectively have enable levels.

8. A pixel circuit of an organic light emitting display, comprising:

a first transistor comprising a first electrode adapted to receive a pixel voltage, a second electrode electrically connected to an organic light emitting device, and a gate;

a second transistor comprising a first electrode adapted to receive a data voltage, a second electrode connected to the first electrode of the first transistor, and a gate adapted to receive a first scan signal;

a third transistor connected between the second electrode of the first transistor and the gate of the first transistor, and for allowing the first transistor to function as a diode;

a capacitor comprising a first electrode connected to a power line for supplying the pixel voltage, and a second electrode connected to the gate of the first transistor;

a fourth transistor comprising a first electrode connected to the power line, a second electrode connected to the first electrode of the first transistor, and a gate adapted to receive an emission control signal;

a fifth transistor comprising a first electrode connected to the second electrode of the first transistor, a second electrode connected to an anode of the organic light emitting device, and a gate adapted to receive the emission control signal; and a sixth transistor comprising a first electrode connected to the second electrode of the capacitor, a second electrode, and a gate adapted to receive a second scan signal.

9. An organic light emitting display comprising:

a plurality of data lines adapted to transmit a data voltage;

a plurality of scan lines adapted to transmit a scan signal;

a plurality of organic light emitting devices adapted to display an image corresponding to the data voltage; and a plurality of pixel circuits electrically connected to the data lines, the scan lines, and the organic light emitting devices, wherein at least one of the pixel circuits comprises:

a first transistor adapted to supply a current to the organic light emitting device;

a second transistor adapted to supply the data voltage to a first electrode of the first transistor in response to a first scan signal;

a third transistor adapted to connect a second electrode of the first transistor with the gate of the first transistor; and a capacitor adapted to store a voltage corresponding to the data voltage when the first scan signal is applied to the second transistor, and adapted to supply the stored voltage to the gate of the first transistor for the organic light emitting device to emit light;

a fourth transistor adapted to cut off a pixel voltage from being applied to the first electrode of the first transistor in response to an emission control signal;

a fifth transistor adapted to cut off an electrical connection between the second electrode of the first transistor and the organic light emitting device in response to the emission control signal; and a sixth transistor adapted to discharge the voltage stored in the capacitor in response to a second scan signal.

10. The organic light emitting display according to claim 9, wherein the sixth transistor comprises a first electrode connected to the capacitor, a gate adapted to receive the second scan signal, and a second electrode connected to a scan line for transmitting the second scan signal.

11. The organic light emitting display according to claim 10, wherein the second scan signal and the first scan signal are sequentially transmitted, and the emission control signal is transmitted with a disable level, and wherein the first and second scan signals are shifted to respectively have enable levels.

12. The organic light emitting display according to claim 11, further comprising a scan driver adapted to supply the first and second scan signals to at least one of the plurality of scan lines and adapted to supply the emission control signal to an emission control line connected to the fourth transistor and the fifth transistor.

13. The organic light emitting display according to claim 9, further comprising a data driver adapted to supply the data voltage to at least one of the plurality of data lines.

* * * * *